US005917777A

United States Patent [19]

Tanigawa

[11] Patent Number: 5,917,777

[45] Date of Patent: Jun. 29, 1999

[54] APPARATUS AND A METHOD FOR CONTROL OPERATING TIME OF INFORMATION DISPLAY MEANS

[75] Inventor: Mitsunobu Tanigawa, Kanagawa, Japan

[73] Assignee: NEC Corporation, Tokyo, Japan

[21] Appl. No.: 09/099,880

[22] Filed: Jun. 17, 1998

[30] Foreign Application Priority Data

Jun. 17, 1997 [JP] Japan ..... 9-159608

[51] Int. Cl.[6] ..... G04B 47/00; G09G 3/36

[52] U.S. Cl. ..... 368/10; 368/82; 345/99; 345/211

[58] Field of Search ..... 368/10, 82–84, 368/239–243; 345/87, 95, 96, 99, 211

[56] References Cited

U.S. PATENT DOCUMENTS 5,610,627 3/1997 Inamori et al. ..... 345/99

5,751,278 5/1998 Inamori et al. ..... 345/211

*Primary Examiner*—Vit Miska

*Attorney, Agent, or Firm*—Scully, Scott, Murphy & Presser

[57] ABSTRACT

In an apparatus for control operating time of information display means, a program is operated by a first system clock, which has a pre-established period, a second system clock, which has an error in its period, being used to operate a timer, the amount of time until the generation of a timer interrupt request being measurement by the program which is operated by a first system clock, and the oscillation frequency of the second system clock being calculated from the results of that measurement. The number of timer interrupt request signals to be counted and the number of the wait program to be executed are set based on the oscillation frequency of the second system clock, this number of timer interrupt request signals being counted, and the set number of the wait program being executed, so as to perform fine adjustment.

7 Claims, 11 Drawing Sheets

APPARATUS AND A METHOD FOR CONTROL OPERATING TIME OF INFORMATION DISPLAY MEANS

BACKGROUND OF THE INVENTION

1. Field of the Invention

The present invention relates to an apparatus and a method for control operating time of information display means, and more specifically to an apparatus for control display time of an IC card reader which measures the error of an oscillation frequency beforehand, and which varies a timer count number of times in accordance with the oscillation frequency error to compensate display time of an IC card reader.

2. Description of Related Art

The prior art will be described with regard to an IC card reader that is suitable for application of the present invention.

FIG. 7 shows the system configuration of an IC card reader. This is a system which use in combination with an IC card which serves as electronic money. In this IC card reader, an IC card 4 is inserted into a card reader/writer 3, a microcomputer 2 of the IC card reader reads the amount information of the money that has been deposited onto the IC card 4 by means of communications with the IC card, this amount information being displayed on an LCD panel 1.

The IC card reader is supplied to the user of an IC card as an accessory to the IC card at the time the IC card is purchased, and is a use-and-discard system that is discarded when the battery 5 thereof becomes depleted. For this reason, it is necessary to reduce the manufacturing cost as much as possible, and instead of using a high-cost quartz resonator as the resonator in the microcomputer system, an RC oscillator circuit, which has a low cost but also a low oscillation error accuracy, is used.

FIG. 8 is a block diagram which shows the clock circuit used in the IC card reader. The RC oscillator circuit 20 used for the main system clock has a CPU stop signal 36, which stops the oscillation, connected to it, so that when either a STOP signal 40, which is generated when the STOP command is executed, or the CPU stop register bit 41 is input, the CPU stop signal 36, which is produced by the OR gate 31, is input to the RC oscillator circuit 20 for the main system clock, thereby stopping the oscillation thereof.

In this microcomputer, to achieve an even further reduction in cost, the capacitor 33 in the RC oscillator for the main system clock, and the resistance 35 and capacitor 34 in the RC oscillator circuit 21 for the subsystem clock are built onto the silicon chip of the microcomputer.

The resistance 35 and the capacitors 33 and 34 that are built onto the silicon chip of the microcomputer exhibit variations in the manufacturing processes therefor, this resulting in a large error. With regard to RC oscillator circuit 21 for the subsystem clock in particular, since the resistance 35 and capacitor 34 are both built-in, depending upon the manufacturing lot, the oscillation frequency error can be as much as ±50%.

With regard to the main system clock, because a resistance 32 is mounted outboard with respect to the chip, enabling the use of an arbitrary resistance of high precision, the oscillation frequency error is relatively small, although in some microcomputers, in the case in which the main system clock 20 is used to operate the microcomputer, compared to the case in which the subsystem clock 21 operates the microcomputer, there can be an approximate 25-fold increase in power consumption.

It is necessary to have an IC card reader operate for a period of 2 to 3 years, and to extend the lifetime of the system batter 5, except at times when communication with the IC card 4 is being done, the main system clock 20 oscillation is stopped by inputting the CPU stop register bit 41.

For the reasons noted above, the control of the LCD display time is performed by the subsystem clock 21 operating a timer. Therefore the oscillation frequency error is large and, there is a large variation in the LCD display time.

However, because an IC card system is for the purpose of receiving the information of the amount of money deposited onto an IC card and displaying this information on an LCD display panel, the LCD display time accuracy is a very important factor, and it is generally necessary to hold the display time error to within about ±20%.

For example, if the LCD display time is shorter than an established time, whereas the display time for one screen requires 2 seconds, the screen will, for example, be displayed for only approximately 1.3 seconds (in the case in which the oscillation frequency error is ±50%), making the displayed information difficult to see.

In the reverse case, if the LCD display time is excessively long, for example, in the case in which the oscillation frequency error is −50%, a simple calculation shows that the current consumption will be increased to a maximum of 1.5 times, thereby resulting in a commensurate shortening of the battery life.

Next the display time control method in which the above-noted problem occurs will be described. FIG. 9 is a block diagram of the time control system used in the prior art. In the display time control system used in the past, the number of the timer interrupt request signal is set to the display time setting program, and the timer that is operated by the subsystem clock is started. Then, a number of timer interrupt request signals equal to the number of the timer interrupt request signal which is set to the display time setting program and, at the point at which the count is completed, the display is ended.

FIG. 10 (*a*) and (*b*) are flowcharts of the time control system of the past. First, the display time setting procedure shown in FIG. 10 (*a*) will be described. The number of the timer interrupt request signal is set (170), and the timer that is operated by the subsystem clock is started (171).

Next, the display time control procedure shown in FIG. 10 (*b*) will be described. In this procedure, the timer interrupt request signal is monitored (180) and, if an interrupt request is generated, the number of interrupt request signal is decremented (181). Then, the number of the timer interrupt request signal is checked to see if it is 0 and, if it is 0 (182), the display is ended (183). As shown in FIG. 11, in the case in which the timer interrupt request signal generates every 500 ms and the display time is 2000 ms, the display time is controlled by counting the timer interrupt request signal 4 times.

Next, the case in which an error occurs in the subsystem clock of the microcomputer will be described. In the case in which an error in a constituent element causes the oscillation frequency of the subsystem clock to have an error on the excessively high side, so that, as shown in FIG. 12, if the timer interrupt request signal generates every 370 ms (an oscillation frequency error of ±35%), when the timer interrupt request signal is counted 4 times, the display time is 1480 ms.

In the reverse condition, in which the oscillation frequency is excessively low, as shown in FIG. 13, if the timer interrupt request generates every 770 ms (an oscillation frequency error of −35%), when the timer interrupt request signal is counted 4 times, the display time is 3080 ms.

In this manner, when using a microcomputer into which are built a resistance and a capacitor for use in a system clock, error in the capacitance and resistance values that make up the resonator cause a frequency error in the system clock, thereby preventing the accurate operation of the display time control timer, this resulting in variations in the display time. When these variations occur, the readability of the displayed information declines, and the power consumption increases.

In this case, in a microcomputer which has only a timer having a long time from the timer start until the generation of a timer interrupt request, when the above-noted timer is used to control the display time, even if the number of counts of the timer interrupt request signal is changed, it is not possible to compensate the error in a display time.

In view of the above-described drawbacks in the prior art, an object of the present invention is to compensate the display time error and improve performance, by varying the number of counts of the timer interrupt request signal.

SUMMARY OF THE INVENTION

To achieve the above-noted object, the present invention is an apparatus for controlling operation time of an information display means in that a first clock and a second clock are used and said first clock having a frequency lower than that of said second clock while said first clock having a higher accuracy than that of said second clock, an operation time of said information display means being controlled by said second clock, wherein said apparatus comprising; a means for calculating a period of said second clock; a first time calculating means for calculating a first display time bases upon said period of said second clock with respect to a predetermined operation time of said display means; and a second time calculating means for calculating a second display time by repeating an execution of a wait processing program established for adjusting time with a predetermined numbers of times so as to establish a predetermined operating time, and wherein said second time calculating means calculating the display time by substituting the first display time calculated by said first time calculating means from a total display time.

Another feature of the present invention is that measurement is made of how many period of said second clock correspond to said operation time thereof and then said clock number thus measured being input in said first time calculating means while measurement being made of calculation for said first display time by said first time calculating means by outputting said second clock from a second clock generating means with a number of times corresponding to the number of said clock number.

Another feature of the present invention is that measurement is made of how many number of times said wait processing program for adjusting time, had been executed with respect to said operating time, and then said executed number thus measured being input in said second time calculating means, while measurement being made of calculation for said second display time by said second time calculating means by executing said wait processing program with a number of times corresponding to the number of said execution of said wait processing program.

Further, another feature of the present invention is that said means for calculating a period of said second clock serving to operate a timer means with said first clock and to calculating a time until a timer interrupt request being generated based upon said second clock in said timer means, further to measure the period of said second clock based upon said result of said measurement.

In this apparatus and a method for control operating time of information display means, a program is operated by a first system clock, which has a pre-established period, a second system clock, which has an error in its period, being used to operate a timer, the amount of time until the generation of a timer interrupt request being measurement by the program which is operated by a first system clock, and the oscillation frequency of the second system clock being calculated from the results of that measurement. The number of timer interrupt request signals to be counted and the number of the wait program to be executed are set based on the oscillation frequency of the second system clock, this number of timer interrupt request signals being counted, and the set number of the wait program being executed, so as to perform fine adjustment.

Because the present invention adopts the above-noted configuration, regardless of how the oscillation frequency of the subsystem clock of the microcomputer varies, it is possible to obtain a constant processing time for the display time.

And by providing the wait program for a short processing time, it is possible to compensate a time that is shorter than the timer interrupt request generation time, so that even when using a microcomputer having only a timer with a long time from the timer start until a timer interrupt request is generated, it is possible to compensate a display time error.

DESCRIPTION OF THE DRAWINGS

FIG. 3(*b*) is a drawing which shows the display time for the case in which an error occurs which causes the clock oscillation frequency to decrease.

DETAILED DESCRIPTION OF THE PREFERRED EMBODIMENTS

Embodiments of present invention are described below, with reference being made to the relevant accompanying drawings.

The first embodiment of the present invention will be described below, with reference to relevant accompanying drawings. The hardware used in the present invention is the same as in the prior art.

Figure 4:
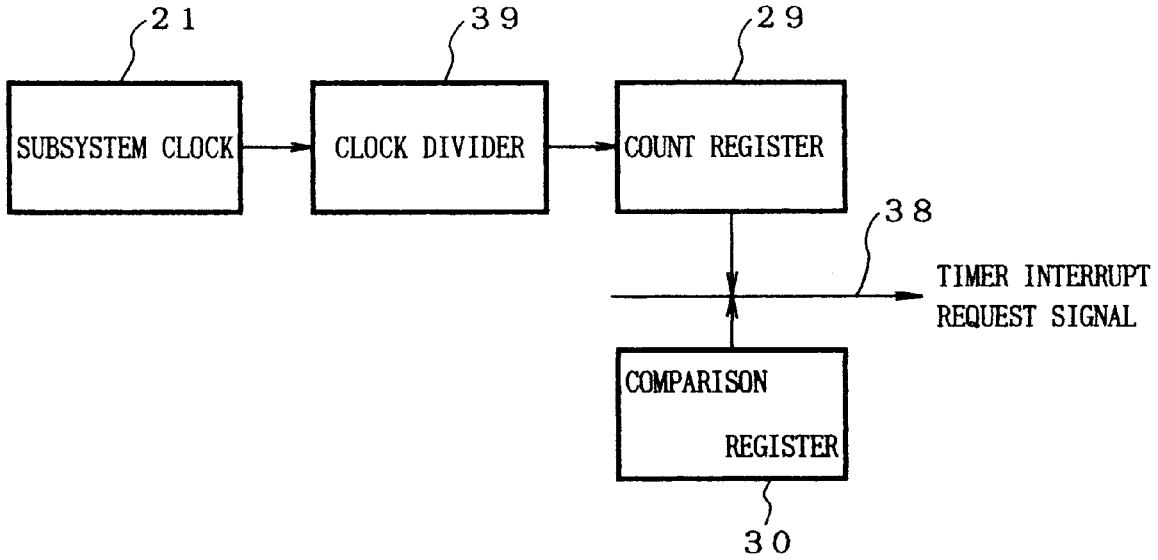
FIG. 4 is a block diagram of a timer which is operated by a subsystem clock.
Figure 8:
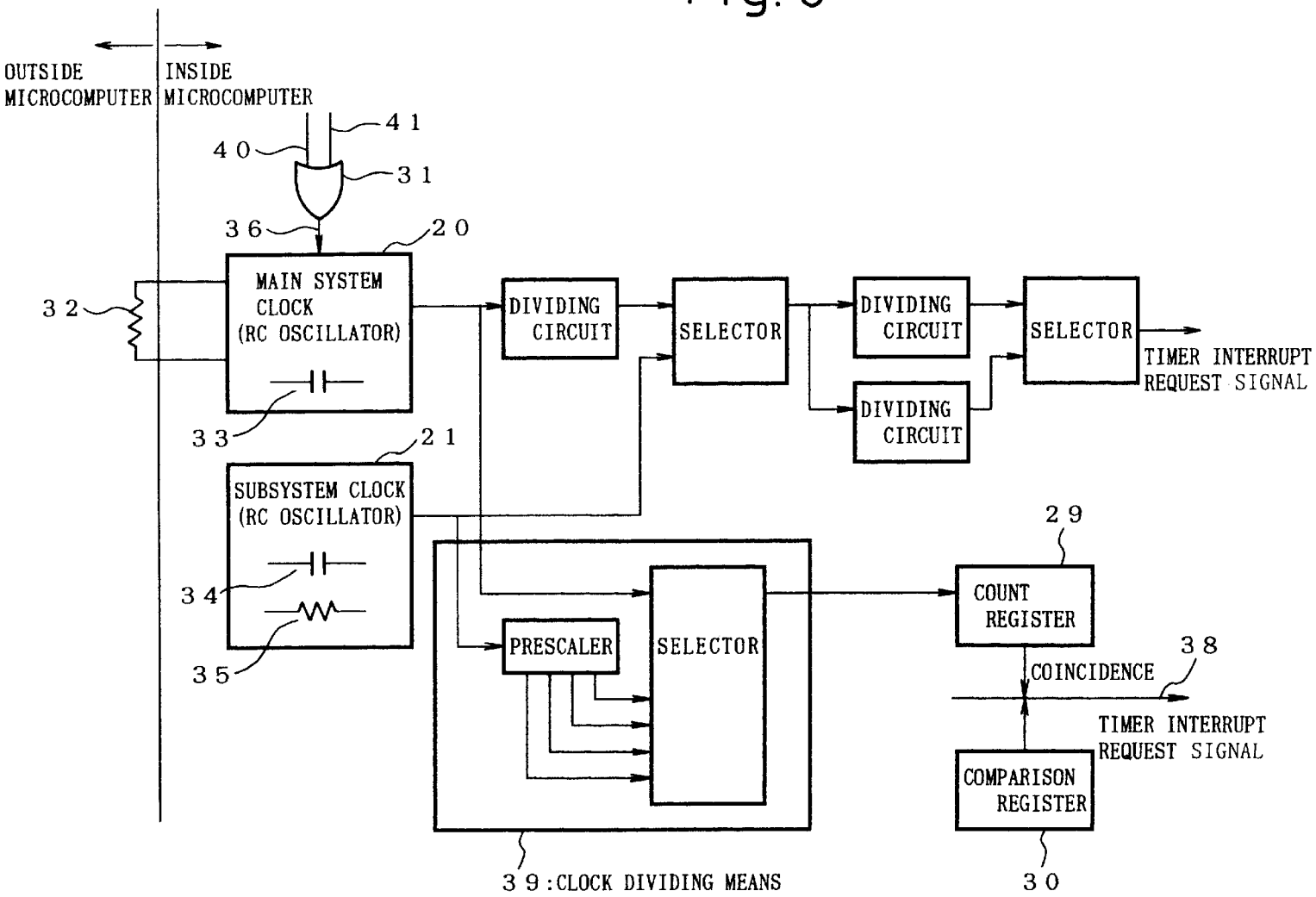
FIG. 8 is a block diagram of the clock circuit used in an IC card reader.
Figure 9:
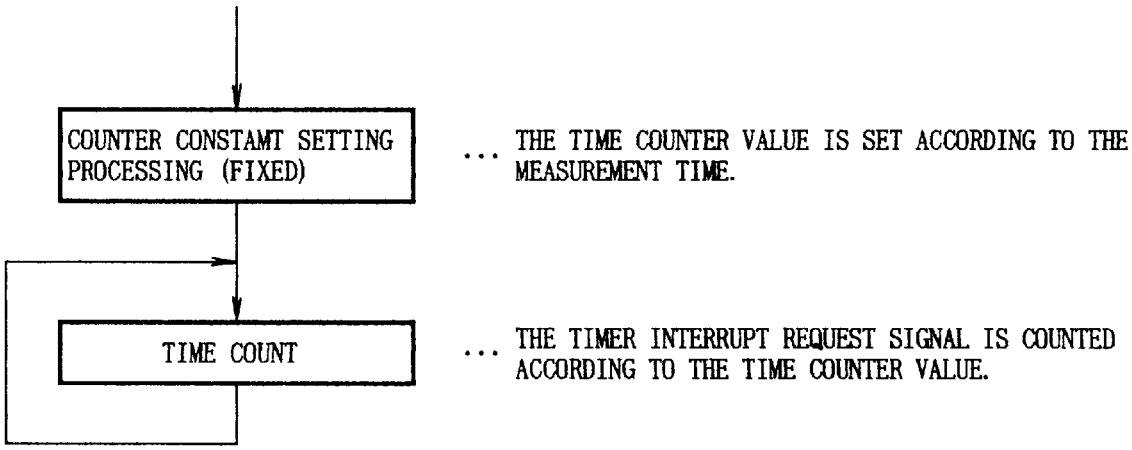
Fig. 9 PRIOR ART
FIG. 9 is a block diagram of a time control system in the past.
Figure 10:
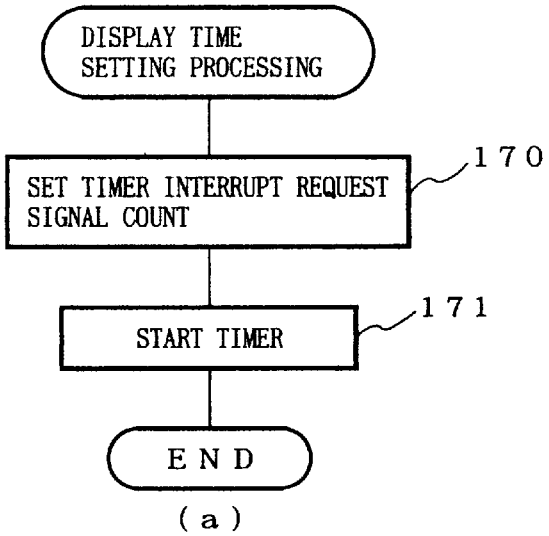
Fig. 10 PRIOR ART
FIG. 10 is a flowchart of the operation of display time control procedure in the past.
Figure 11:
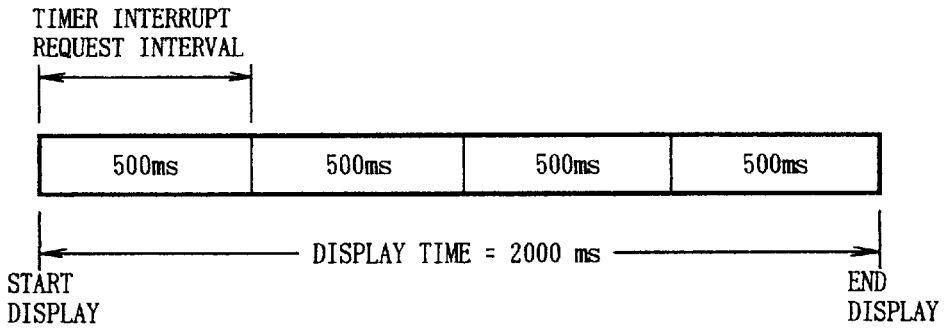
Fig. 11 PRIOR ART
FIG. 11 is a drawing which shows the display time for the case in which no error occurs in the system clock oscillation frequency in the past.
Figure 12:
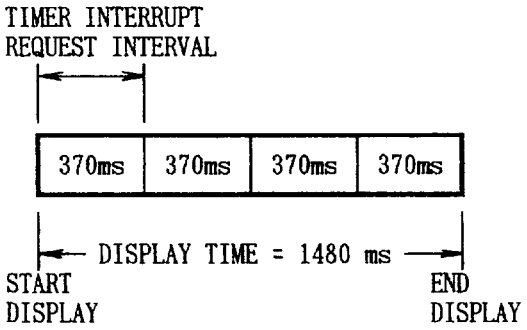
Fig. 12 PRIOR ART
FIG. 12 is a drawing which shows the display time for the case in which an error occurs which causes the system clock frequency to increase in the past.
Figure 13:
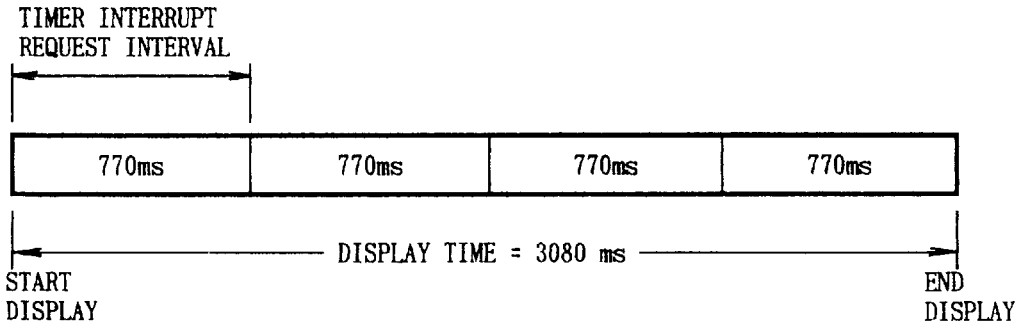
Fig. 13 PRIOR ART
FIG. 13 is a drawing which shows the display time for the case in which an error occurs which causes the system clock frequency to decrease in the past.

FIG. 4 is a block diagram of a timer for use in display time control section, this drawing showing just the timer part of FIG. 8, which is for the purpose of generating a timer interrupt request signal 2 (38). The reference numeral 21 denotes a subsystem clock, 39 is a clock dividing means, 29 is a count register, 30 is a comparing register, and 38 is the timer interrupt request signal.

When a pre-established value is set into the comparison register 30 and the timer is started, clock dividing means 39 divides the clock, this divided clock causing the count register 29 to be counted up, and when this coincides with the comparison register 30, the timer interrupt request signal 38 is output.

In the oscillation frequency measuring procedure, the time from the point at which the timer is started until the output of the timer interrupt request signal is measured by a program that is operated by the main system clock.

Figure 1:
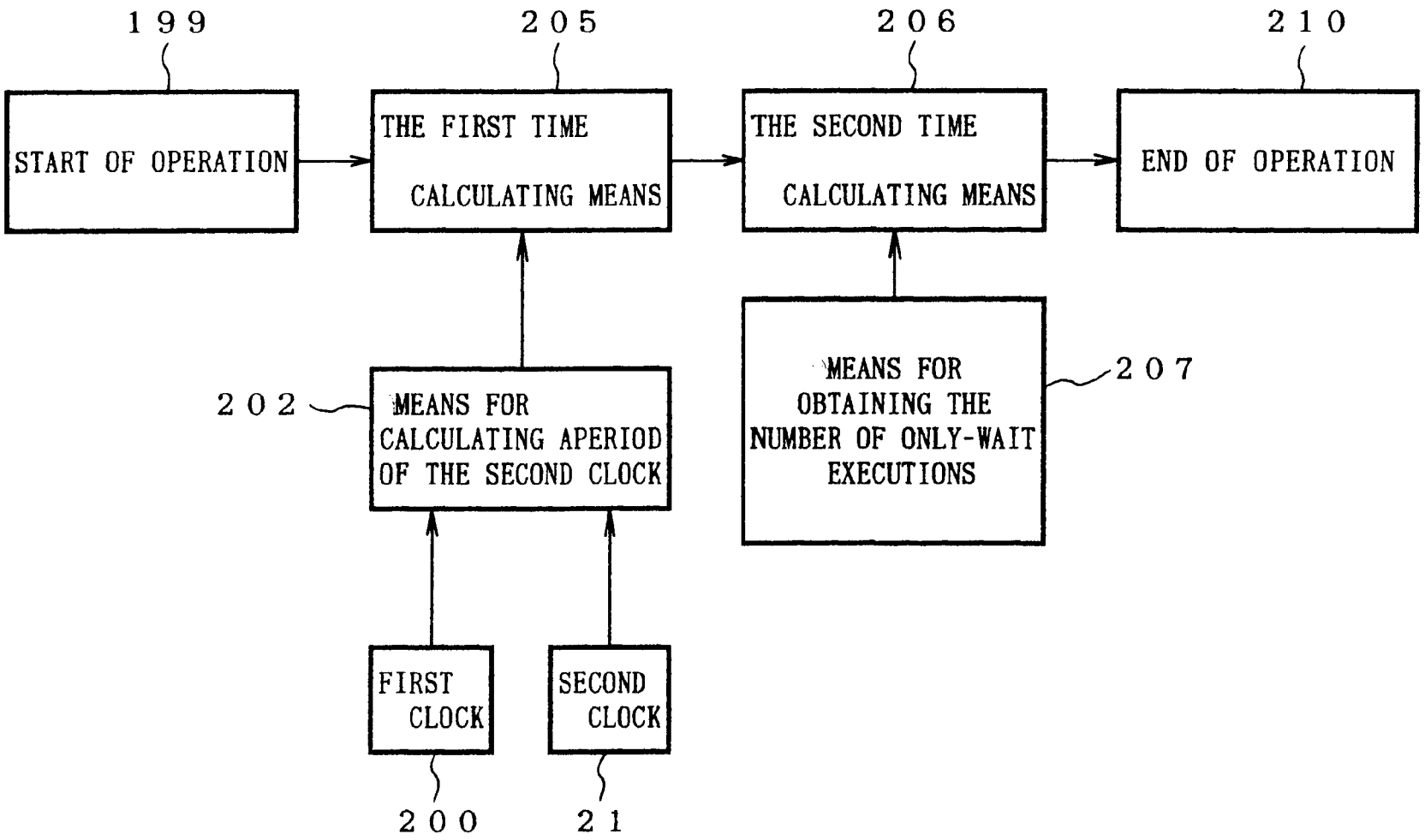
FIG. 1 is a block daigram of the first embodiment of the present invention.

FIG. 1(*a*), (*b*), and (*c*) are flowcharts that show the processing procedure in the case in which the first embodiment of the present invention is applied to control display time in an IC card reader. In this system, the system clock that is set beforehand to a pre-established period is the main system clock, the system clock that has an error in its period is the subsystem clock, and the time control procedure controls the display time of the IC card reader.

The oscillation frequency measurement procedure for the subsystem clock shown in FIG. 2(*a*) will be described.

First, the program operation clock is set to the main system clock (100), and the RAM which indicates the subsystem clock oscillation frequency, which is not shown in the drawing, is cleared (101). Next, the pre-established value for the timer is set into the comparison register (102), and the timer is started (103).

Then, the timer interrupt request signal is monitored (104) and, if an interrupt request is generated, the dividing value is incremented (105), and return is made to the monitoring procedure of the timer interrupt request signal (104). From the dividing value at the time that the oscillation frequency measurement processing procedure is completed, it is possible to obtain the oscillation frequency of the subsystem clock from the following equation.

Actual subsystem clock oscillation frequency = Normal subsystem clock oscillation frequency × (Timer setting time / (Processing time for 104-105) × dividing value)) — Equation 1

Next, the display time setting procedure of FIG. 2(*b*) will be described.

The display time is controlled by the number of the timer interrupt request signals and the number of executions of the wait program(only-wait program). The number of timer interrupt request signals and the number of executions of the wait program are calculated from the oscillation frequency determined from the above-noted oscillation frequency measurement procedure which is shown in FIG. 2(*a*), using the following equations.

The number of interrupt request signal = Display time / (Timer setting value × Normal subsystem clock oscillation frequency / Actual subsystem clock oscillation frequency) — Equation 2

The number of the interrupt request signal is truncated so as to obtain an integer value.

Number of executions of the wait program = (Display time − Timer setting time × (Normal subsystem clock oscillation frequency / Actual subsystem clock oscillation frequency) × The number of interrupt request signal) / Execution time of the wait program — Equation 3

The number of the interrupt request signal and the number of executions of the wait program calculated by using the above-noted equations are set as setting values of the software timer (110, 111). Then, the timer operated by the subsystem clock is started (112).

Next, the display time control procedure will be described. The timer interrupt request signal is monitored (120) and, if an interrupt request is generated, the number of the interrupt request signal is decremented (121). Then, a check is made to see whether the number has reached 0 (122). If the number is 0, the wait program is executed (123). Then, the number of execution of the wait program is decremented (124) and if this number has reached 0 (125), the display is ended.

In the case shown in FIG. 3(*a*), in which the timer interrupt request generation time is shortened to 370 ms (an oscillation frequency error of +35%), if the normal subsystem clock oscillation frequency is 32.0 kHz, the actual subsystem clock oscillation frequency can be calculated as follows.

Actual subsystem clock oscillation frequency= 32.0×1.35=43.2 kHz — Equation 4

With a display time is 2000 ms and a timer setting time of 500 ms, if the execution time of the wait program is 3.7 ms, the number of the interrupt request signal and the number of execution of the wait program can be calculated as follows from Equations 2 and 3.

The number of interrupt request signal= 2000/(500×3.2/43/5)=5 — Equation 5

Number of execution of the wait program= (2000−(500×32.0/43.2)×5)/3.7 ms)=40 — Equation 6

According to the above-noted calculation results, the timer interrupt request signal is counted 5 times and the 3.7-ms wait program is executed 40 times.

Under the above-noted conditions, the following calculation of the display time can be made.

Display time=(37 ms×5)+(3.7 ms×40)=1998 ms — Equation 7

Figure 3A:
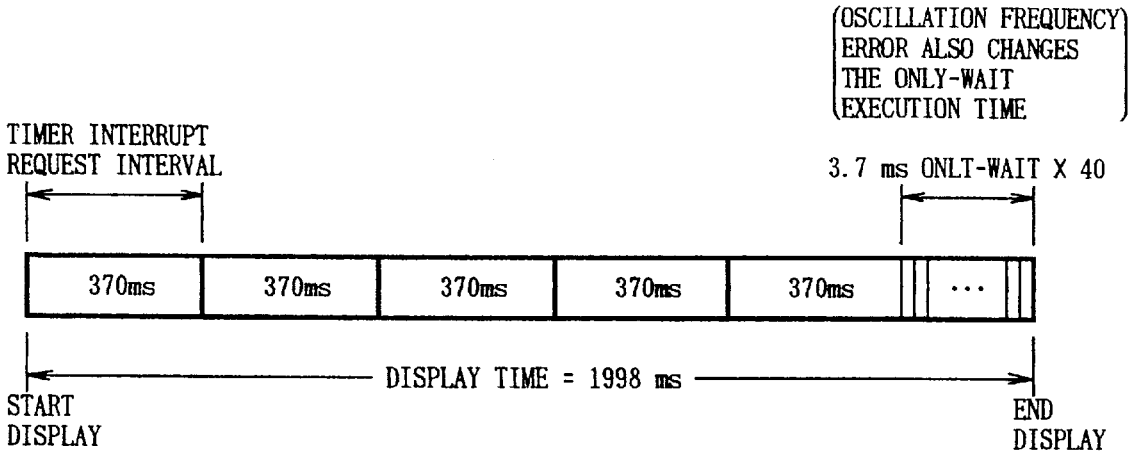
FIG. 3(*a*) is a drawing which shows the display time for the case in which an error occurs which causes the clock oscillation frequency to increase.
Figure 3B:
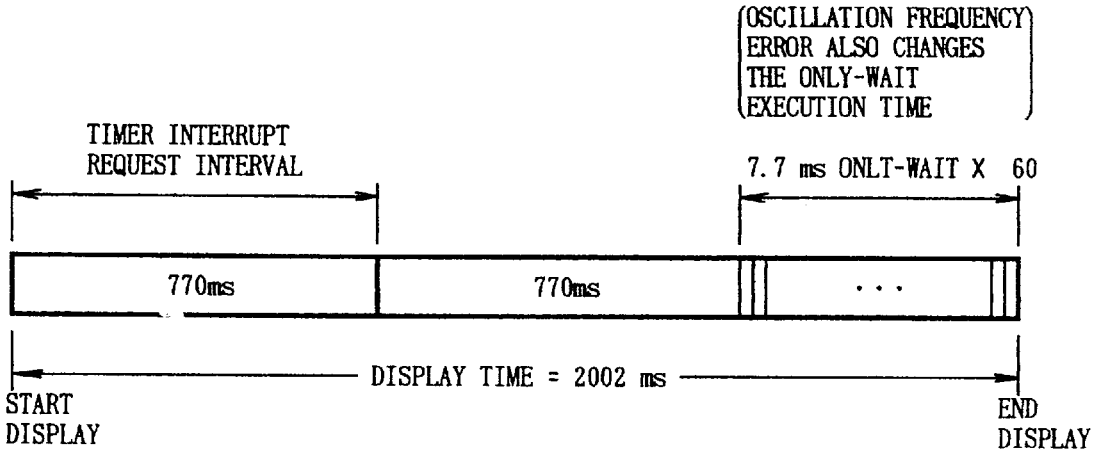

If, as shown in FIG. 3(*b*), the timer interrupt request generation time is lengthened to 770 ms (an oscillation frequency error of −35%), if the normal subsystem clock oscillation frequency is 32.0 kHz, the actual subsystem clock oscillation frequency can be calculated as follows.

$$\text{Actual subsystem clock oscillation frequency} = 32\times0.65=20.8\ \text{kHz} \quad \text{Equation 8}$$

With a display time of 2000 ms and a timer setting time of 500 ms, if the execution time of the wait program is 7.7 ms, the number of the interrupt request signal and the number of execution of the wait program can be calculated as follows from Equations 2 and 3.

$$\text{Interrupt request signal count} = 2000/(500\times32.0/20.8)=2 \quad \text{Equation 9}$$

$$\text{The number of execution of the wait program} = (2000-(500\times32.0/20.8)\times2)/7.7\ \text{ms})=60 \quad \text{Equation 10}$$

According to the above-noted calculation results, the timer interrupt request signal is counted 2 times, and the 7.7 ms wait program is executed 60 times.

Under the above-noted conditions, the following calculation of the display time can be made.

$$\text{Display time} = (770\ \text{ms}\times2)+(7.7\ \text{ms}\times60)=2002\ \text{ms} \quad \text{Equation 11}$$

Summarizing the above-noted operation, the time until the generation of a interrupt request which is operated by the subsystem clock, is measured in a program that is operated by the main system clock and, the number of the timer interrupt request signal and the number of executions of the wait program being calculated from this measurement result, the timer interrupt request signal being counted the calculated number of times and the execution of the wait program being performed the calculated number of times to compensate the display time.

Next, the second embodiment of the present invention will be described in detail, with reference being made to the relevant accompanying drawings.

Figure 5:
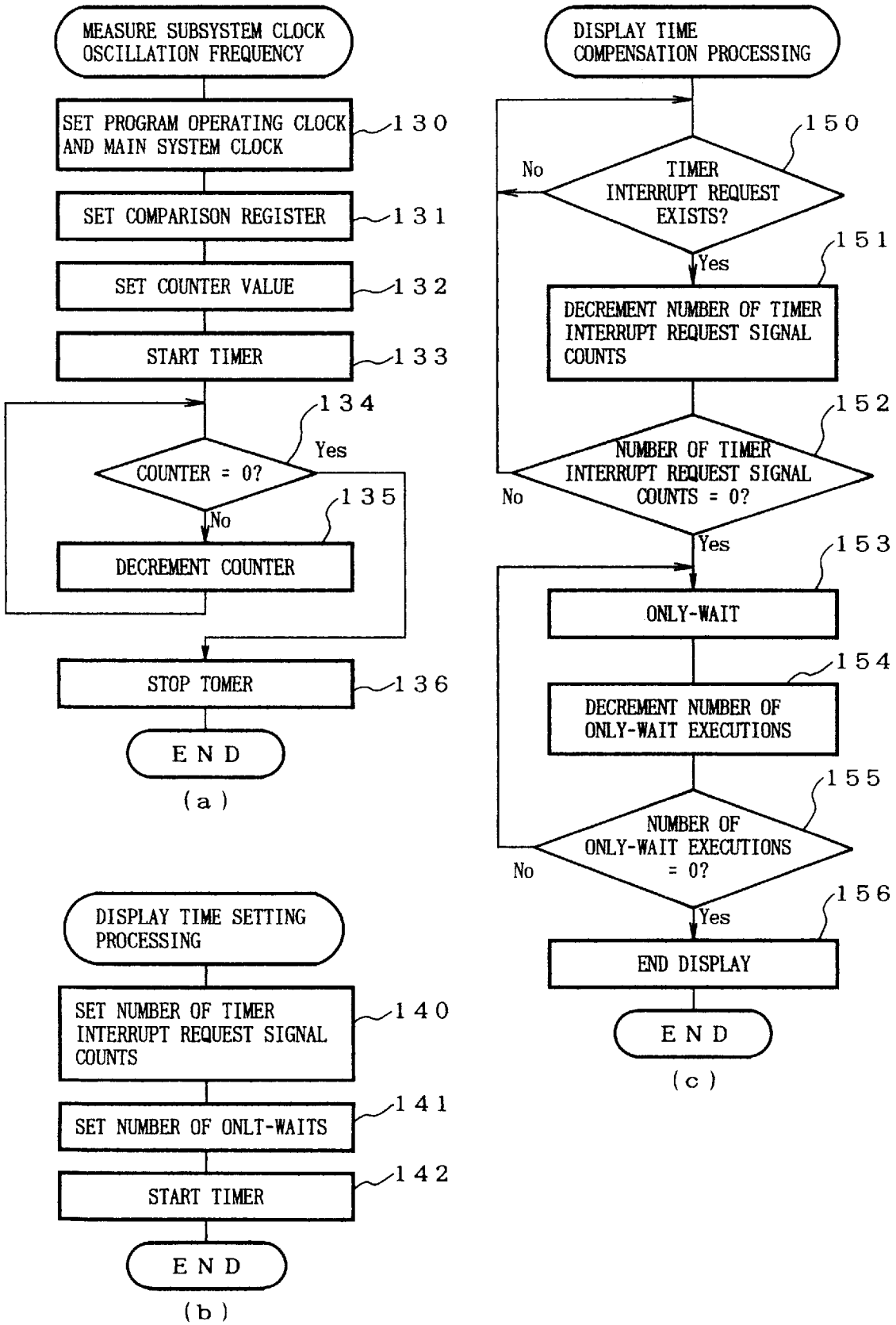
FIG. 5 is a flowchart of the operation of the second embodiment of the present invention.
Figure 6:
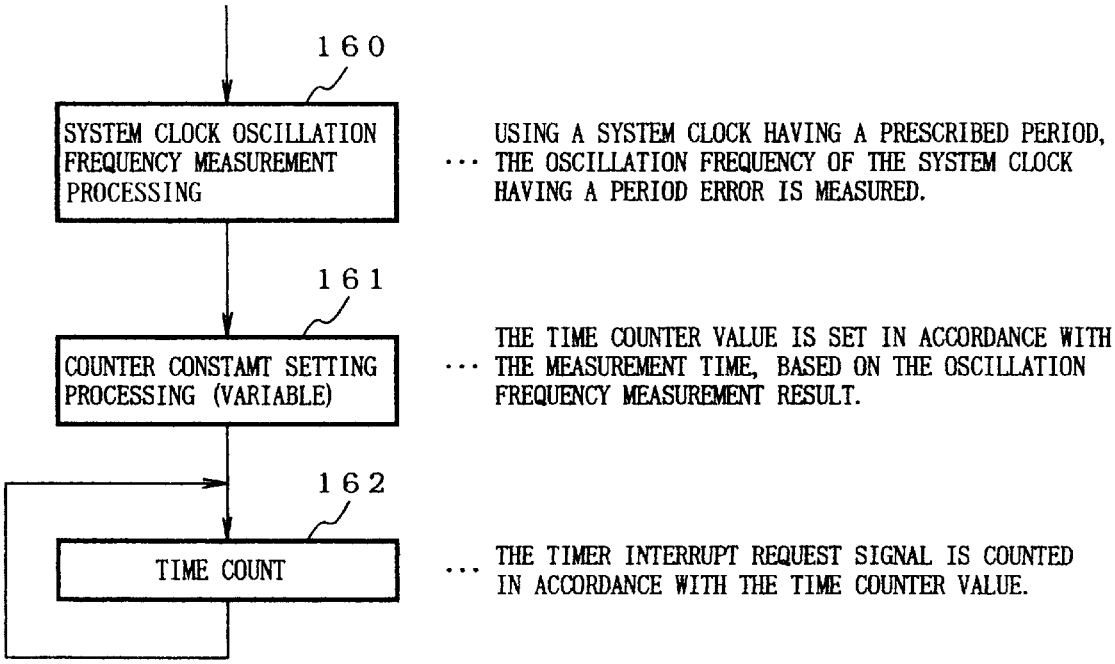
FIG. 6 is a block diagram of a time compensation system.
Figure 7:
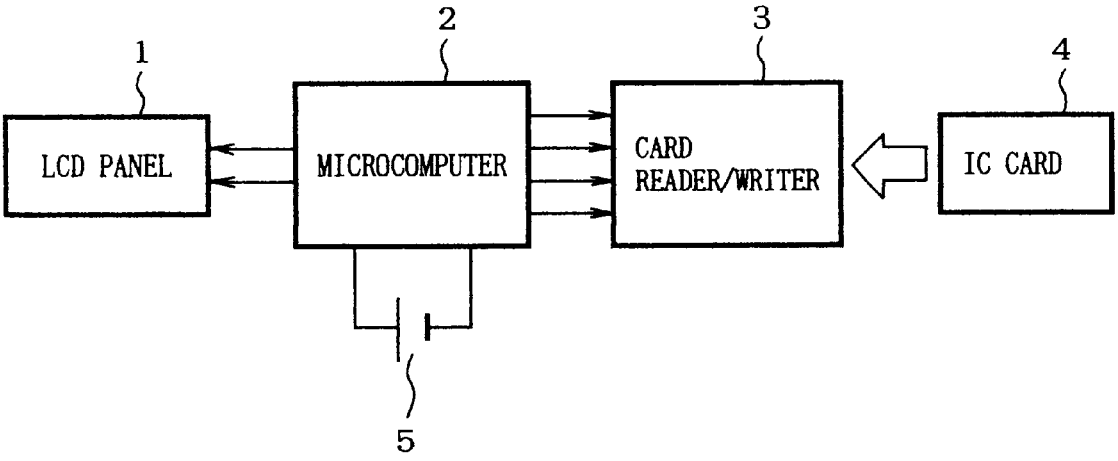
FIG. 7 is a system block diagram of an IC card reader.

The hardware used in the present invention is the same as in the prior art. FIG. 5 is a flowchart which shows the operation of the second embodiment of the present invention which is applied to display time control system in an IC card reader.

Figure 2:
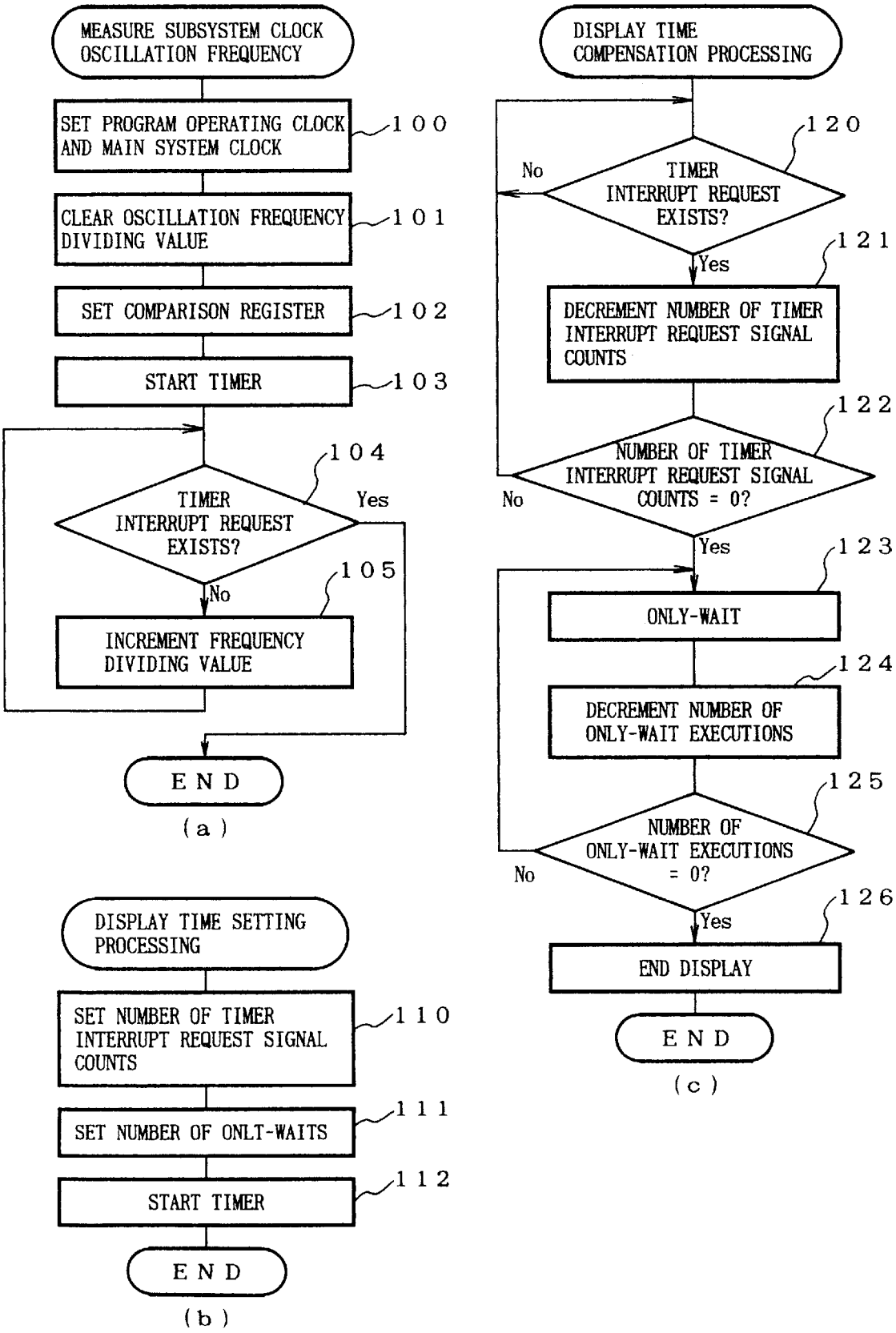
FIG. 2 is a flowchart of the operation of the first embodiment of the present invention.

With regard to the above-noted flowcharts, FIG. 5(*b*) and FIG. 5(*c*) are the same as FIG. 2(*b*) and FIG. 2(*c*). The system clock that is set beforehand to a pre-established period is the main system clock, the system clock that has an error in its period is the subsystem clock, and this time control procedure is applied to control the display time.

The processing procedure to measure the oscillation frequency of the subsystem clock is as follows.

First, the program operation clock is set to the main system clock (130). Next, the pre-established value for measuring the error is set into the comparison register (131), a timer data is set into the timer for measuring the reference time (132), and the timer is started (133). Then, the counter is decremented until it reaches 0 (134, 135). At the point at which the counter reaches 0, the timer for measuring the error is stopped.

From the timer count register value at the time the oscillation frequency measurement procedure is ended, the subsystem clock oscillation frequency is calculated, using the following equation.

$$\text{Actual subsystem clock oscillation frequency} = \text{Normal subsystem clock oscillation frequency}\times(\text{Reference time}/(\text{Count register value}\times\text{timer count-up time})) \quad \text{Equation 12}$$

The actual subsystem clock oscillation frequency calculated by using the above-noted Equation 12 is used in the same display time setting procedure and display time control procedure that was described with regard to the first embodiment.

As described above, the present invention is an apparatus for controlling operation time of an information display means in that a first clock 200 and a second clock 21 are used and said first clock 200 having a frequency lower than that of said second clock 21 while said first clock 200 having a higher accuracy than that of said second clock 21, an operation time of said information display means being controlled by said second clock 21, wherein said apparatus comprising; a means 202 for calculating a period of said second clock 21; a first time calculating means 205 for calculating a first display time bases upon said period of said second clock 21 with respect to a predetermined operation time of said display means; and a second time calculating means 206 for calculating a second display time by repeating an execution of a wait processing program established for adjusting time with a predetermined numbers of times so as to establish a predetermined operating time, and wherein said second time calculating means 206 calculating the display time by substituting the first display time calculated by said first time calculating means from a total display time.

As described above, by setting the number of the timer interrupt request signal and the number of executions of the wait program based on a measurement of the oscillation frequency of the subsystem clock, and by counting the thus-determined timer interrupt signal and executing the wait program the thus-determined number of times so as to compensate the processing time, as applied to control a display time, the present invention is capable of control the display time, regardless of the manner in which the oscillation frequency of the subsystem clock of the microcomputer varies.

By providing the wait program for a short processing time, it is possible to compensate a time that is shorter than the timer interrupt request generation time, so that even when using a microcomputer having only a timer with a long time from the timer start until a timer interrupt request is generated, it is possible to compensate a display time error.

What is claimed is:

1. An apparatus for controlling operation time of an information display means in that a first clock and a second clock are used and said first clock having a frequency lower than that of said second clock while said first clock having a higher accuracy than that of said second clock, an operation time of said information display means being controlled by said second clock, wherein said apparatus comprising;

a means for calculating a period of said second clock;

a first time calculating means for calculating a first display time based upon said period of said second clock with respect to a predetermined operation time of said display means; and a second time calculating means for calculating a second display time by repeating an execution of a wait processing program established for adjusting time with a predetermined number of times so as to establish a predetermined operating time, and wherein said second time calculating means calculating the display time by substituting the first display time calculated by said first time calculating means from a total display time.

2. An apparatus for controlling operation time of an information display means according to claim 1, wherein measurement is made of how many periods of said second clock correspond to said operation time thereof and then said clock number thus measured being input in said first time calculating means while measurement being made of calculation for said first display time by said first time calculating means by outputting said second clock from a second clock generating means with a number of times corresponding to the number of said clock number.

3. An apparatus for controlling operation time of an information display means according to claim 2, wherein measurement is made of how many number of times said wait processing program for adjusting time had been executed with respect to said operating time, and then said executed number thus measured being input in said second time calculating means, while measurement being made of calculation for said second display time by said second time calculating means by executing said wait processing program with a number of times corresponding to the number of said execution of said wait processing program.

4. An apparatus for controlling operation time of an information display means according to claim 1, wherein said means for calculating a period of said second clock serving to operate a timer means with said first clock and to calculate a time until a timer interrupt request being generated based upon said second clock in said timer means, further to measure the period of said second clock based upon said result of said measurement.

5. An apparatus for controlling operation time of an information display means according to claim 1, wherein said apparatus being further provided with a means for measuring a frequency of said second clock.

6. An apparatus for controlling operation time of an information display means according to claim 1, wherein said apparatus being further provided with a means for calculating number of execution of said wait processing program based upon either said frequency or said period of said second clock.

7. A method for controlling an operation time of an information display means in that a first clock and a second clock are used and said first clock having a frequency lower than that of said second clock while said fist clock having a higher accuracy than that of said second clock, an operation time of said information display means being controlled by said second clock, wherein said method comprising the steps of;

a first step for calculating a period of said second clock;

a second step for measuring a number of execution for interrupting operation with a period of said second clock;

a third step for measuring a number of execution for wait processing program with respect to said operation time;

a fourth step for operating said apparatus;

a fifth step for calculating said first display time based upon said interrupting number as required in said second step;

a sixth step for calculating said second display time by executing said wait processing program with a predetermined number of times based upon said number of execution for said wait processing program as required in said third step; and a seventh step for stopping said operation of said apparatus.

* * * * *